United States Patent [19]

Seidl

[11] 4,377,990

[45] Mar. 29, 1983

[54] CYLINDER READ FOR WATER-COOLED INTERNAL COMBUSTION ENGINES MANUFACTURABLE BY THE DIE-CASTING METHOD

[75] Inventor: Jiri Seidl, Munich, Fed. Rep. of Germany

[73] Assignee: Bayerische Motoren Werke A.G., Munich, Fed. Rep. of Germany

[21] Appl. No.: 196,485

[22] PCT Filed: Aug. 10, 1979

[86] PCT No.: PCT/EP79/00063

§ 371 Date: May 8, 1980

§ 102(e) Date: May 8, 1980

[87] PCT Pub. No.: WO80/00595

PCT Pub. Date: Apr. 3, 1980

[30] Foreign Application Priority Data

Sep. 8, 1978 [DE] Fed. Rep. of Germany ..... 2839199

[51] Int. Cl.[3] ..... F02F 1/36

[52] U.S. Cl. ..... 123/41.82 R; 123/41.74

[58] Field of Search ..... 123/41.72, 41.74, 41.75, 123/41.79, 41.82 R, 41.82 A, 193 H

[56] References Cited

U.S. PATENT DOCUMENTS 2,230,225 2/1941 Anderson ..... 123/41.82R 2,298,213 10/1942 Jardine ..... 123/41.82 R 2,339,972 1/1944 Anderson et al. ..... 123/41.82 R 3,942,487 3/1976 Zink ..... 123/41.79

4,131,093 12/1978 Mansfield ..... 123/41.82 R

FOREIGN PATENT DOCUMENTS 2417925 10/1974 Fed. Rep. of Germany ... 123/41.82 R

*Primary Examiner*—Craig R. Feinberg

*Assistant Examiner*—W. R. Wolfe

*Attorney, Agent, or Firm*—Craig & Burns

[57] ABSTRACT

A water cooled cylinder head for an internal combustion engine which may be manufacturable by die-casting method in which all of the niche - shape water galleries are connected to the water jacket of the cylinder block through deformable openings in the cylinder head gasket surrounding the combustion chambers in which the openings are connected by cross channels and a lateral longitudinal channel. The upper limit of longitudinal channel is formed by the highest point in water galleries and cross channels wherein the longitudinal channel has a water outlet opening. A special arrangement of the niche-shaped water galleries, cross channels, and openings in cylinder head gasket with respect to the main components of cylinder head controls the cooling of the cylinder head in an advantageous manners.

3 Claims, 2 Drawing Figures

CYLINDER READ FOR WATER-COOLED INTERNAL COMBUSTION ENGINES MANUFACTURABLE BY THE DIE-CASTING METHOD

BACKGROUND AND SUMMARY OF THE INVENTION

The invention relates to a cylinder head, manufacturable by the die-casting method, for water-cooled internal combustion engines with an in-line cylinder arrangement, with a plurality of niche-shaped water galleries connectable to the cooling jacket of the cylinder block, connected by cross channels and by a lateral longitudinal channel with one another.

In a known die-cast cylinder head of this design (German Offenlegungsschrift No. 21 13 840), the niche-type water galleries extend into the cylinder head from various directions. A portion of the water galleries is enclosed by a flange of the intake and/or exhaust system, designed as a cover, while another part of the water galleries must be enclosed in a cumbersome manner by a plurality of individual force-fitted cover plates. The cylinder head also has a considerable water content, which results in a high operating weight, a long warm-up time, and locally small water flow rates. Furthermore, the bores for the cylinder head bolts are disposed irregularly about the combustion chambers, and additional force-fitted cover plates or plugs are required to seal the cross channels, which run crosswise through some of these bores.

The goal of the invention is to provide a cylinder head of the aforementioned type, manufacturable by the die-casting method, which permits efficient cooling of points exposed to high heat stress with a low water content, and can be manufactured in a simple and economical fashion.

This goal is achieved by the invention in that all niche-shaped water galleries of the cylinder head are deformable at the cylinder head-cylinder block interface, and are disposed essentially around combustion chambers, the upper limit of the longitudinal channel being the highest point of the water galleries and the channels, and the longitudinal channel comprising a water outlet. The design according to the invention eliminates a great many of the water galleries which must be sealed off from the outside, with a high water content. Moreover, with bored cross channels, the inlet openings need be sealed only by plugs, covers, or flanges on the intake or exhaust manifold, which does not necessitate great expense. The cross channels and longitudinal channel used to carry away the cooling water produces a pronounced cross flow of the cooling water through the cylinder head.

Indeed, a cylinder head is already known (German Offenlegungsschrift No. 27 56 006), which is provided only with water galleries in the shape of ring segments that are open only toward the cylinder head gasket side, and an elevated longitudinal channel, but in this cylinder head, no cross channels with an improved cooling action are provided, and the cooling water is essentially conducted only lengthwise through the cylinder head, so that local temperature peaks develop.

According to a disclosed, preferred embodiment of the present invention the cylinder head is provided with bores for cylinder head bolts, four of the bores are associated with each combustion chamber such that they are located roughly on a circle about its center, two adjacent combustion chambers each have two bores in common, and each two niche-shaped water chambers are located essentially on an imaginary connecting line running at right angles to the row of combustion chambers, whereby they are each adjacent to one of the bores for cylinder head bolts and at least one combustion chamber. Such an arrangement according to the invention produces good cooling of adjacent or sequential parts of the combustion chambers and cylinders, especially in internal combustion engines with extremely small distances between the cylinders, or with cylinder sleeves which are cast in one piece. According to a further feature of the disclosed, preferred embodiment the cylinder head is provided with a cross channel running between two adjacent combustion chambers and an additional cross channel which runs parallel thereto, between inlet and outlet valves of the cylinder head, and wherein a cross channel is disposed at each end of the row of combustion chambers, the cross channels are disposed diagonally with respect to the row of combustion chambers, and the water galleries, located on the imaginary connecting line, are disposed on different sides of channels and are cut accordingly from different sides through cross channels. Such a configuration permits the cross channels to be guided past bores for cylinder head bolts and favor a staggered valve arrangement with short inlet and outlet channels and a corresponding arrangement of the spark plugs. As an additional feature of the present invention the longitudinal channel of the cylinder head terminates at one end of the cylinder head with an end opening, and expands continuously toward the latter. Such a configuration permits shaping the longitudinal channel during casting. Also, according to one form of the invention the longitudinal channel runs close to and along combustion chambers with bores for spark plugs on the side of the cylinder head which is located opposite the longitudinal channel. This arrangement favors the cooling of the combustion chamber zones which are remote from the spark plugs and has a positive influence in making the combustion chamber resistant to knocking. Further, in an internal combustion engine with a cylinder head according to the present invention, a cylinder head gasket is disposed between the cylinder head and the cylinder block. The gasket comprises openings running from the water jacket of the cylinder block to the niche-shaped water galleries with the cross sections of the openings increasing with their distance from the longitudinal channel.

In the preferred embodiment the openings located on the side of the cylinder head which is opposite the longitudinal channel each have at least the same cross section as a cross channel and the openings adjacent to the longitudinal channel have a much smaller cross section, which is approximately $\frac{1}{4}$ to $\frac{1}{2}$ of the cross section of the aforementioned openings. The provision of such openings in the gasket supports the formation of a pronounced cross flow through the cylinder head.

BRIEF DESCRIPTION OF THE DRAWING

The drawing shows one embodiment of the invention.

DETAILED DESCRIPTION OF THE DRAWING

Figure 1:
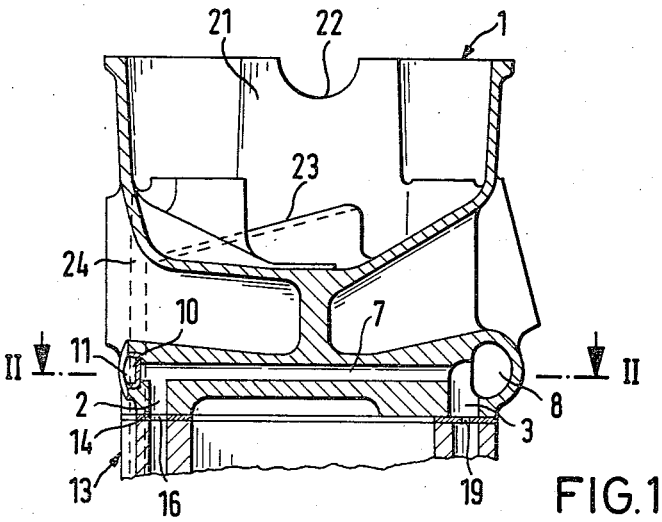
FIG. 1 is a section along line I—I in FIG. 2 of a die-cast cylinder head for water-cooled internal combustion engines.
Figure 2:
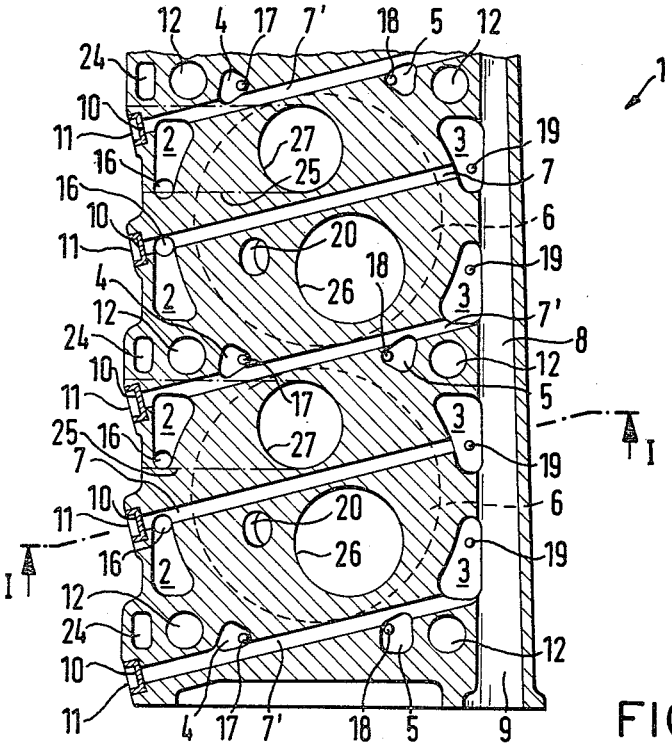
FIG. 2 is a cross section along line II—II in FIG. 1.

A die-cast cylinder head 1 for water-cooled internal combustion engines comprises a plurality of niche-shaped water galleries 2, 3, 4, and 5. The niche-shaped water galleries 2–5 are deformable to fit the interface between the cylinder head and cylinder block, and are disposed about combustion chambers 6. Water galleries 2 and 3 are located outside cylinder head 1 and water galleries 4 and 5 are disposed above outlets from water gallery corners, determined by cylinder sleeves, possibly cast in one piece, in the cylinder block. Water galleries 2–5 are connected together by cross channels 7 and 7', running diagonally to the row of combustion chambers 6, whereby water galleries 4 are cut primarily on the rear and water galleries 5 are cut primarily on the front. An elevated longitudinal channel 8 is provided on one side of cylinder head 1. It connects cross channels 7 and 7' as well as water galleries 3 located on this side, with one another, and serves to carry away the cooling water. It is deformable toward its end opening 9, so that only the diagonal cross channels 7 and 7' need by drilled. Inlet openings 10 of cross channels 7 and 7' are sealed by plugs 11.

Bores 12 for cylinder head bolts, not shown, are disposed perpendicularly to the interface between the cylinder head and cylinder block and on a circle around each combustion chamber 6 and/or the central lengthwise axis of this cylinder. Two adjacent combustion chambers 6 each have two bores 12 in common. Each of two niche-shaped water galleries 4 and 5 is located on a connecting line between two bores 12, located on an imaginary connecting line running perpendicular to the row of combustion chambers 6. Their diagonal arrangement causes cross channels 7 and 7' to bypass bores 12.

FIG. 1 shows cylinder head 1 together with the upper part of a cylinder block 13 and a cylinder gasket 14, disposed therebetween. Openings 16, 17, 18, and 19, which run from the water jacket 15 of cylinder block 13 into niche-shaped water galleries 2–5, are located in cylinder head gasket 14. Openings 16, located furthest from longitudinal channel 8, are the largest and each have at least the same cross section as a cross channel 7 or 7'. Openings 19, located closest to longitudinal channel 8, are the smallest and their cross section is about $\frac{1}{4}$ to $\frac{1}{2}$ of the cross section of openings 16.

Bores 20 to accept spark plugs, not shown, are located on the side of cylinder head 1 which is opposite longitudinal channel 8. Collecting and guide channels 23 are disposed in the upper part of cylinder head 1 of valve chamber 21, below camshaft bearings 22, said channels rapidly conducting the lubricating oil, emerging from the camshaft bearings, to drain channels 24. This causes the lubricating oil to flow back into the cylinder block 13 without being heated excessively.

The arrangement of the niche-shaped water galleries 2–5 on the cylinder head gasket side produces a good deformability of cylinder head 1. Cross channels 7 and 7' run especially close to the hot areas of the cylinder head, such as outlet channels 25, valve seats 26 and 27, and bores 20 for the spark plugs, so that a good cooling effect is achieved especially at these points, which are subjected to high heat stress. This is favored by the selection of the cross sections for openings 16 to 19 to the niche-shaped water galleries, located in cylinder head gasket 14, said openings being sharply throttled on the side of longitudinal channel 8, so that a specific flow is produced between cross channels 7 and 7'. Their parallel arrangement allows all of the cross channels 7 and 7' to be drilled at the same time. They require only a small, conventional, seal-less cover plate as a plug 11. Their diagonal arrangement means that cross channels 7 and 7' do not interfere with bores 12 for the cylinder head bolts and favor a staggered valve arrangement with short inlet and outlet channels and a corresponding arrangement of spark plugs.

I claim:

1. Internal combustion engine with a cylinder head producible by the pressure die-casting method with combustion chambers arranged in series, with laterally terminating inlet and outlet ducts controlled by inlet and outlet valves, with bores for cylinder head screws and with several niche-like water spaces being connected to a cooling jacket of a cylinder block, these water spaces being in communication with one another by a lateral longitudinal duct and by transverse ducts, respectively one of these ducts extending between two neighboring combustion chambers and respectively one further duct extending between an inlet valve seat and an outlet valve seat of a combustion chamber wherein the transverse ducts are oriented obliquely to the series of combustion chambers and the bores for cylinder head screws are arranged in pairs at right angles to the series of combustion chambers and intersect without chamfer respectively on opposite sides of the respective transverse ducts, all niche-like water spaces can be formed toward a parting plane between the cylinder head and cylinder block and are arranged essentially all around the combustion chambers, an upper limitation of the longitudinal duct constitutes the highest point of the water spaces as well as of the longitudinal and transverse ducts, and the longitudinal duct has a water drain, and with a cylinder head gasket arranged between the cylinder head and the cylinder block, this gasket having perforations leading from the water jacket of the cylinder block to the niche-like water spaces, and in that the cross sections of the perforations are fashioned to be larger with an increasing distance from the longitudinal duct.

2. Cylinder head producible by the pressure die-casting method for water-cooled multicylinder internal combustion engines with combustion chambers arranged in series, with laterally terminating inlet and outlet ducts controlled by inlet and outlet valves, with bores for cylinder head screws and with seveal niche-like water spaces being connected to a cooling jacket of a cylinder block, these water spaces being in communication with one another by a lateral longitudinal duct and by transverse ducts, respectively one of these ducts extending between two neighboring combustion chambers and respectively one further duct extending between an inlet valve seat and an outlet valve seat of a combustion chamber, characterized in that the transverse ducts are oriented obliquely to the series of combustion chambers and the bores for cylinder head screws are arranged in pairs at right angles to the series of combustion chambers and intersect without chamfer respectively on opposite sides of the respective transverse ducts all niche-like water spaces can be formed toward a parting plane between the cylinder head and cylinder block and are arranged essentially all around the combustion chambers, an upper limitation of the longitudinal duct constitutes the highest point of the water spaces as well as of the longitudinal and transverse ducts, the longitudinal duct has a water drain, the longitudinal duct terminates at one end of the cylinder head with an end aperture and flares continuously toward this end aperture which forms said water drain.

3. Cylinder head according to claim 2, characterized in that the longitudinal duct extends along the combustion chambers in the close proximity thereof, and that bores for sparks plugs are arranged in opposition to the longitudinal duct.

* * * * *